United States Patent [19]

Smith

[11] 4,446,349

[45] May 1, 1984

[54] MICROWAVE PHASE SHIFTING DEVICE

[75] Inventor: Peter H. Smith, Anchorage, Ky.

[73] Assignee: General Electric Company, Louisville, Ky.

[21] Appl. No.: 454,962

[22] Filed: Jan. 3, 1983

[51] Int. Cl.[3] ..... H05B 6/74

[52] U.S. Cl. ..... 219/10.55 F; 219/10.55 R

[58] Field of Search ..... 219/10.55 F, 10.55 E, 219/10.55 R, 10.55 N; 333/208, 209, 81; 34/1

[56] References Cited

U.S. PATENT DOCUMENTS

| | | | |
|---|---|---|---|
| 2,775,741 | 12/1956 | Corbell | 333/31 |
| 3,621,481 | 11/1971 | Perreault et al. | 333/31 |
| 3,843,863 | 10/1974 | Fitzmayer | 219/10.55 |
| 4,099,042 | 7/1978 | Jean et al. | 219/10.55 |
| 4,234,775 | 11/1980 | Wolfberg et al. | 219/10.55 A |
| 4,301,347 | 11/1981 | Quine | 219/10.55 |

FOREIGN PATENT DOCUMENTS

| | | | |
|---|---|---|---|
| 1029995 | 5/1966 | United Kingdom | 219/10.55 |

OTHER PUBLICATIONS

Patent application Ser. No. 411,153 entitled "Dynamic Bottom Feed for Microwave Ovens," filed 8/25/82, in the name of Bakanowski et al.

*Primary Examiner*—B. A. Reynolds
*Assistant Examiner*—M. M. Lateef
*Attorney, Agent, or Firm*—H. Neil Houser; Radford M. Reams

[57] ABSTRACT

An improved phase shifting device for varying the phase of the standing wave in a hollow rectangular waveguide is provided which is particularly applicable to microwave cooking appliances. A metallic septum is constructed at the end of the waveguide remote from the microwave source which extends inwardly into the waveguide from the adjacent waveguide end wall parallel to the narrow walls of the waveguide and electrically connects the broad walls of the waveguide, thereby dividing the waveguide into two sub-waveguides, each of which exhibits a cut-off characteristic at the operating frequency. The leading edge of the septum provides a short circuit termination reference point for the waveguide. The moving parts comprise a pair of dielectric plugs, each of which is received in a respective one of the sub-waveguides for selective movement in tandem from a reference position completely within the sub-waveguides to one or more phase shifting positions in which the plugs extend forward of the septum leading edge toward the microwave source. The shift in the phase of the standing wave varies linearly with the extent of forward displacement of the plugs relative to the septum leading edge. The plugs are selectively moved in tandem relative to the reference position in the sub-waveguides to provide the desired phase shift.

18 Claims, 9 Drawing Figures

MICROWAVE PHASE SHIFTING DEVICE

BACKGROUND OF THE INVENTION

This invention relates generally to devices for shifting the phase of microwave energy propagating in waveguides, and more particularly to such devices applicable to microwave cooking appliances.

Non-uniform spatial energy distribution of microwave energy in the cooking cavity of microwave ovens is a problem of long standing for such appliances.

One approach to this problem has been to employ phase shifting devices in the feed waveguides. One example of such an approach is described in commonly-assigned U.S. Pat. No. 4,301,347 in which a phase shifter is used in combination with a circular polarizing element to radiate microwave energy into the cooking cavity with rotating elliptical polarization. The phase shifter described therein is a mechanical phase shifter comprising a resonant loop secured to a shaft journalled in the narrow walls of the waveguide, which shaft is rotated by magnetron cooling air. Reference is also made to the use of conventional electronic phase shifters, either solid state or ferrite.

In commonly-assigned, copending U.S. patent application, Ser. No. 411,153, filed Aug. 25, 1982 by Bakanowski et al, an array of slots is arranged along the waveguide to support a substantially stationary first radiating pattern when a first phase relationship for the standing wave exists in the waveguide, and a second radiating pattern when a second phase relationship exists in the waveguide. Phase shifting means is employed to periodically change the phase relationship to switch radiating patterns in the cooking cavity. The mechanical phase shifting means used in Bakanowski et al includes a solenoid actuated plunger positioned a quarter wavelength from the waveguide termination, which is inserted into the waveguide to physically shift the short circuit termination from the end wall to the plunger position, and a rotatable planar conductive vane which when oriented parallel to the broad walls has a minimal effect on the phase of the standing wave, but when oriented transverse to the broad walls provides a short circuit termination.

Mechanical phase shifters, such as employed in the Bakanowski system, provide the desired phase shift but include some less desirable features. The physical movement of metallic probes or vanes involve metal touching or closely approaching the waveguide walls, presenting the possibility of current arcing and contact wear.

The use of longitudinally movable metallic termination devices which in effect move the conductive end wall of the waveguide can be used to selectively vary the phase shift of the standing wave in the waveguide. However, arcing problems are severe at the interface of the waveguide side walls, particularly in typical microwave oven waveguide configurations where the height-to-width ratio for the guide is small, resulting in a relatively high voltage gradient per unit height. In addition, the metal-on-metal movement must overcome a relatively high coefficient of friction and is subject to considerable wear. Finally, the amount of shift introduced is equal to the longitudinal displacement of the metallic termination device; thus, to introduce a quarter wave phase shift, the device must move a distance equal to a quarter guide wavelength. Frequently, such displacement requires complex moving means and may require more space to accommodate the means for moving the device than would be preferred.

The insertion of dielectric material into a waveguide to change the phase of the standing wave in the guide is a well known technique. However, the phase shift in regions of the waveguide relatively remote from the material depends upon the presence or absence of the material in the guide, but not the relative longitudinal position of the material in the waveguide. Thus, longitudinal movement of a dielectric slab in a typical waveguide will not appreciably change the phase of the standing wave in regions of the guide relatively remote from the slab. Thus, while a dielectric slab avoids the arcing problem and the friction and mechanical wear problems inherent with movable conductive metal parts, use of dielectric slabs in conventional fashion does not provide the capability to selectively vary the phase of the standing wave throughout the waveguide by movement of the slabs in the waveguide.

In view of the advantageous use of phase shifters in relieving the problems of non-uniform energy distribution in the microwave cooking appliances and in view of the drawbacks of known mechanical phase shifting devices for such purposes, a mechanical phase shifter comprising a low-cost, non-metallic moving part to selectively shift the phase of the standing wave in the waveguide would be highly desirable.

It is therefore an object of the present invention to provide a phase shifting device applicable to microwave cooking appliances which incorporates low-cost, non-conductive moving parts which provide the desired phase shift, while substantially reducing the occurrence of high current arcing and high voltage breakdown in the waveguide of the appliance.

SUMMARY OF THE INVENTION

An improved phase shifting device for varying the phase of the standing wave in a hollow rectangular waveguide is provided which is particularly applicable to microwave cooking appliances. A metallic septum is constructed at the end of the waveguide remote from the microwave source which extends inwardly into the waveguide from the adjacent waveguide end wall parallel to the narrow walls of the waveguide and electrically connects the broad walls of the waveguide, thereby dividing the waveguide into two sub-waveguides, each of which exhibits a cut-off characteristic at the operating frequency. The leadin edge of the septum provides a short circuit termination reference point for the waveguide. The moving parts comprise a pair of dielectric plugs, each of which is received in a respective one of the sub-waveguides for selective movement in tandem from a reference position completely within the sub-waveguides to one or more phase shifting positions in which the plugs extend forward of the septum leading edge toward the microwave source. The shift in the phase of the standing wave varies linearly with the extent of forward displacement of the plugs relative to the septum leading edge. Means are provided to selectively move the plugs in tandem relative to the reference position in the sub-waveguides to provide the desired phase shift.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings in which:

DETAILED DESCRIPTION

Figure 1:
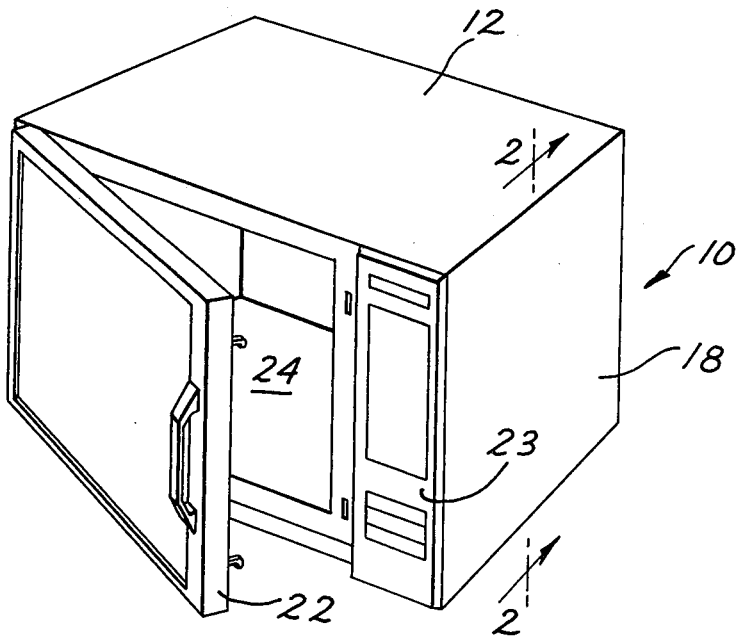
FIG. 1 is a front perspective view of a microwave oven.
Figure 2:
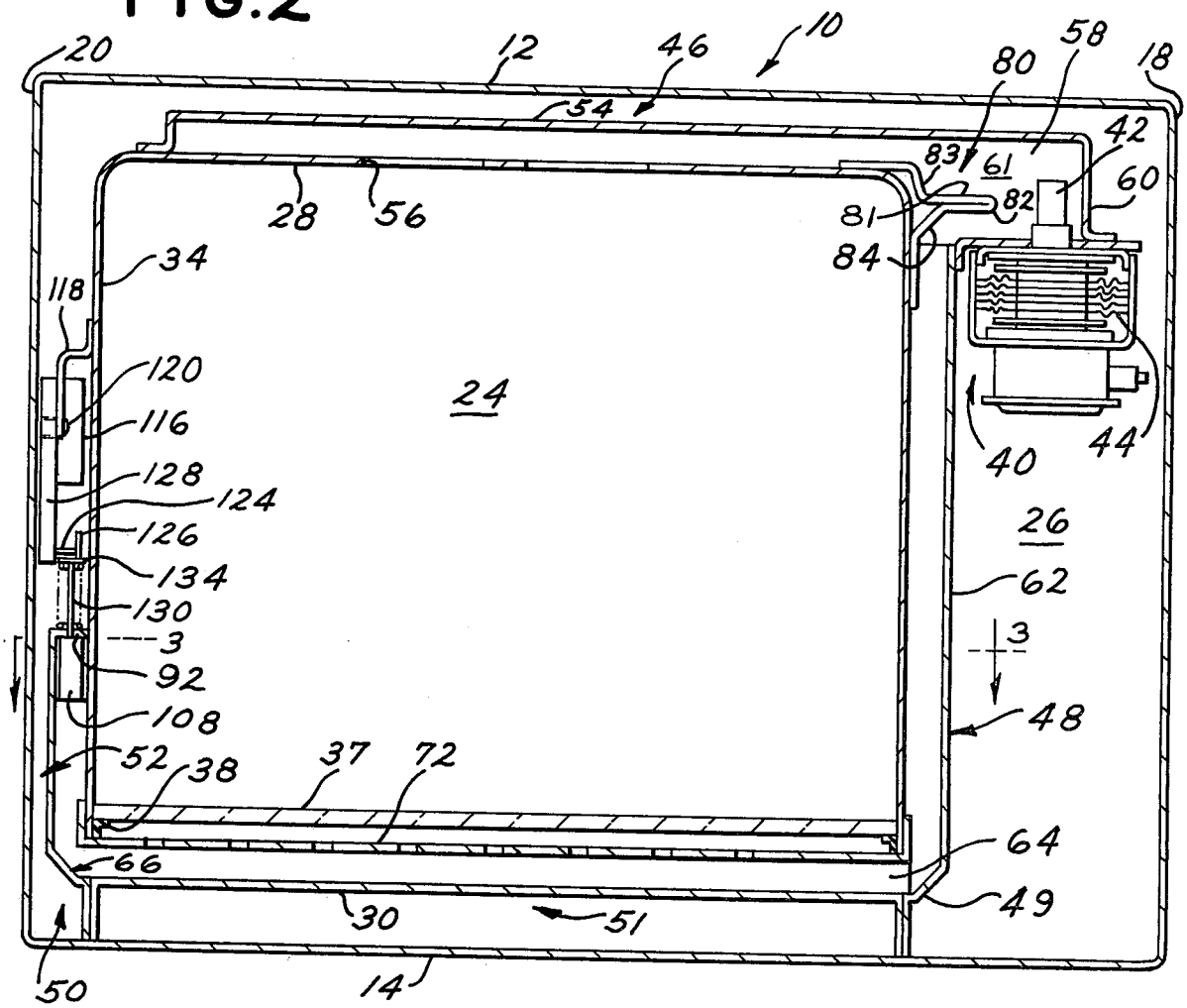
FIG. 2 is a front schematic sectional view of the microwave oven taken along lines 2—2 of FIG. 1.

In the description to follow, the phase shifting apparatus of the present invention is illustratively incorporated in the excitation system of a microwave cooking appliance, an application which makes particularly advantageous use of the invention. It is not intended by this manner of illustration to suggest that the usefulness of the apparatus is limited to such applications. Referring now to FIGS. 1-4, there is shown a microwave oven designated generally 10. The outer cabinet comprises six cabinet walls including upper and lower walls 12 and 14, a rear wall 16, two side walls 18 and 20, and a front wall partly formed by hingedly supported door 22 and partly by control panel 23. The space inside the outer cabinet is divided generally into a cooking cavity 24 and a control compartment 26. The cooking cavity 24 includes a conductive top wall 28, a conductive bottom wall 30, conductive side walls 32 and 34, conductive rear wall, which wall is the cabinet wall 16, and the front wall defined by the inner face of door 22. Nominal dimensions of cavity 24 are 16 inches wide by 13.67 inches high by 13.38 inches deep.

A support plate 37 of microwave pervious dielectric material such as that available commercially under the trademark "Pyroceram" or "Neoceram" is disposed in the lower region of cavity 24 substantially parallel to bottom cabinet wall 14. Support plate 37 provides the means for supporting food objects to be heated in the cavity 24, and defines a plane hereinafter referred to as the cooking plane. Plate 37 is supported from a support strip 38 which circumscribes cavity 24. Strip 38 is secured front to back along cavity side walls 32 and 34 and side to side from bottom wall 30 by expandable tabs (not shown) which project through small holes (not shown) spaced along front and back edges of bottom wall 30 and side walls 32 and 34.

The source of microwave energy for cavity 24 is magnetron 40 which is mounted in control compartment 26. Magnetron 40 has a center frequency of approximately 2450 MHz at its output probe 42 when coupled to a suitable source of power (not shown) such as the 120 volts AC power supply typically available in domestic wall receptacles. In connection with the magnetron, a blower (not shown) provides cooling air flow over the magnetron cooling fins 44. The front facing opening of the controls compartment 26 is enclosed by control panel 23. It will be understood that numerous other components are required in a complete microwave oven, but for clarity of illustration and description, only those elements believed essential for a prope understanding of the present invention are shown and described. Such other elements may all be conventional and as such are well known to those skilled in the art.

Microwave energy is fed from magnetron 40 to the oven cavity 24 through a waveguide having a horizontally extending top feed branch or section 46, a vertically oriented side branch or section 48, and a bottom feed branch 50 comprising a horizontally extending bottom section 51 which extends across the bottom of cooking cavity 24 and a vertically extending terminating section 52 which extends partially up the far side wall 34.

Waveguide sections 46, 48 and 50 are conventionally dimensioned to propagate 2450 MHz microwave energy in the $TE_{01}$ mode. This is accomplished preferably by choosing the width of the section (the dimension running front to rear of the oven) to be more than one-half wavelength but less than one full wavelength and the height of the section (the dimension extruding perpendicular to the adjacent cavity wall) to be less than one-half wavelength. In the illustrative embodiment, the height of sections 46, 48 and 50 are nominally 0.75 inches and the width is nominally 3.66 inches.

The upper waveguide branch 46 runs centrally of upper wall 28 of the cooking cavity and, as shown, is formed by elongated member 54 having a generally U-shaped cross section which is attached by suitable means such as welding to the top wall 28 of cooking cavity 24. Waveguide branch 46 includes two coupling apertures 56 located in wall 28, through which microwave energy is transmitted into the upper region of the cooking cavity 24. The slots 56 extend parallel to the longitudinal dimension of guide 46.

Waveguide section 46 also includes portions 58 and 60 which extend beyond cavity 24 in the direction of the magnetron 40 to enclose an area 61 which serves as a launching area for microwave energy originating at probe 42. Conductive wall 60 serves as a short circuit waveguide termination for area 61 and is conventionally spaced approximately one-sixth guide wavelength from probe 42.

The side waveguide branch 48 runs in a vertical direction centrally of cooking cavity side wall 32 and serves to couple the microwave energy from magnetron 40 to bottom feed waveguide branch 50. Waveguide branch 48 is formed generally by the cavity side wall 32 and an elongated member 62 having a generally U-shaped cross section and suitable flanges for attachment to the side wall 32. A right angle bend is formed by wall portion 49 at the lower end of section 48 to efficiently couple energy from section 48 to section 50.

Microwave energy from launch area 61 in the vicinity of probe 42 of magnetron 40 is split between section 46 and section 48 by bifurcator 80 which operates to provide a stable power split between these sections. Bifurcator 80 is positioned at the junction of three waveguide sections comprising guide sections 46, 48 and launch area 61. The upper portion of bifurcator 80, comprising upper face 81 of horizontally extending divider 82 and step 83, functions as a quarter wave transformer to efficiently match the impedance of guide section 46 to launch area 61 for maximum power transfer. To this end the horizontal length for uppe face 81 is a quarter guide wavelength. The height of step portion 83 is chosen as a function of the height of guide sections 46 and launch area 61 in accordance with conventional quarter wave transformer design. The lower portion of bifurcator 80 provides a conventional mitered corner at 84 for proper impedance matching with side waveguide section 48.

Horizontally extending section 51 of bottom feed waveguide section 50 runs horizontally across the center of bottom wall 30 of cavity 24 approximately underneath upper waveguide section 46 and terminates in vertically extending end portion 52 which extends part way up side wall 34 approximately across from side waveguide section 48.

Bottom waveguide section 51 is made up of a U-shaped cross section member 68 attached to the flat central section 70 of bottom wall 30 of cooking cavity 24. The U-shaped member 68 includes an upper wall 72 which together with flat section 70 of bottom wall 30 provides oppose parallel broad walls and integral side walls 74 extending downwardly toward the bottom wall 30 of cooking cavity 24 which provide opposed parallel narrow walls joining broad walls 72 and 70. Side walls 74 have suitable flanges 76 to facilitate attachment to the bottom wall 30 in a conventional manner, such as by welding. Open end 64 of section 51 is in communication with side branch 48 to receive microwave energy therefrom. At the opposite end of section 51, a right angle bend is formed by wall portion 66 to efficiently couple energy to the vertically extending end portion 52.

Figure 3:
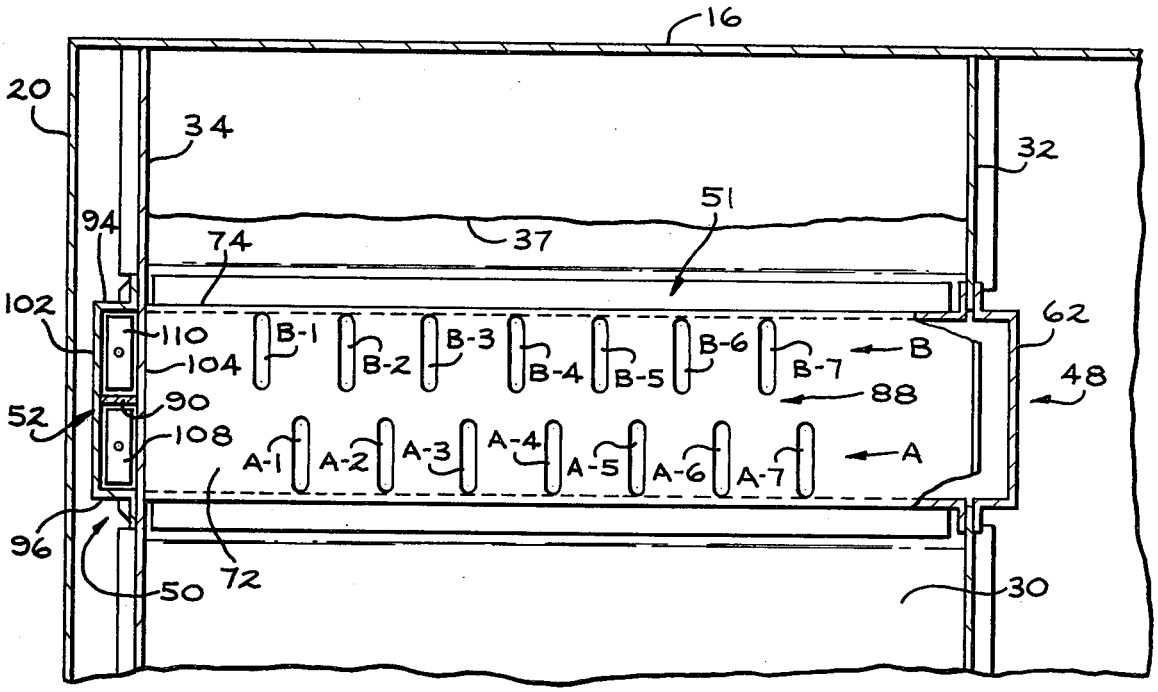
FIG. 3 is a schematic sectional view taken along lines 3—3 of FIG. 2 with portions removed to show the details of the slots in the bottom waveguide.
Figure 4:
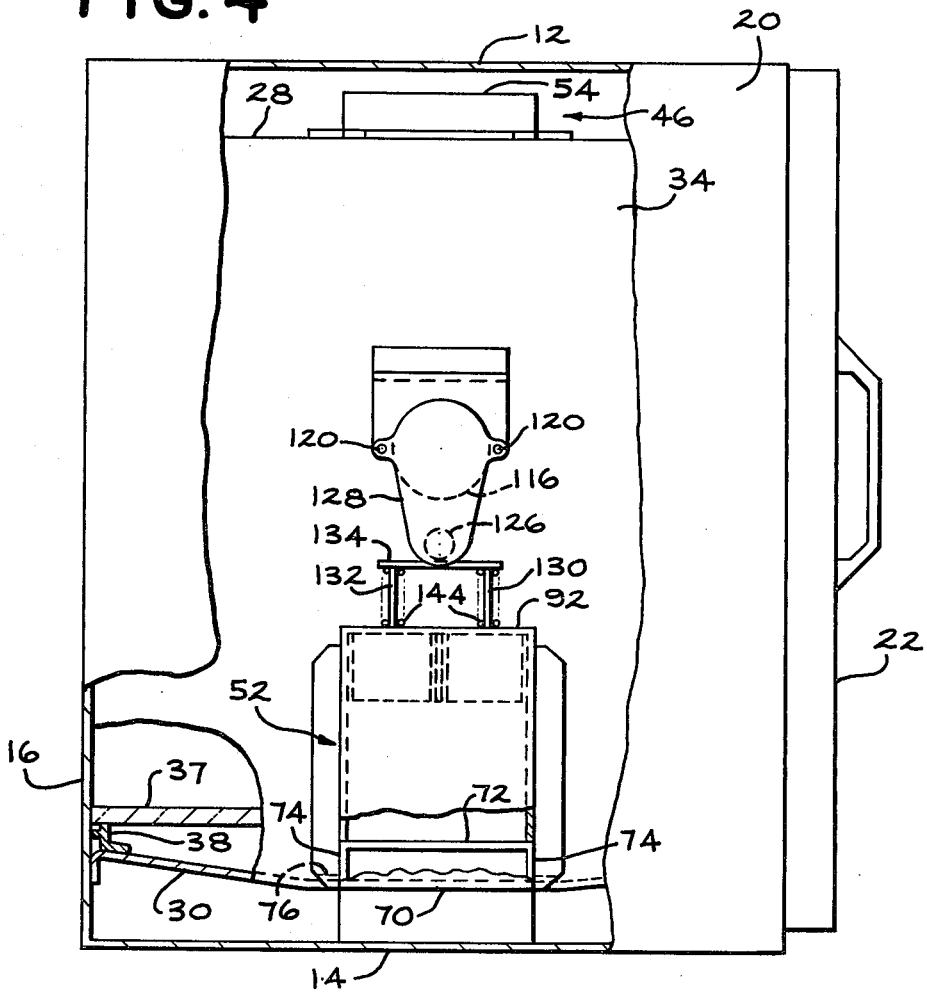
FIG. 4 is a schematic side view partially in section of the microwave oven of FIG. 1 with portions removed to illustrate details thereof.

As best seen in FIG. 3, the upper wall 72 of guide section 50 has formed therein an array of radiating apertures designated generally 88. Apertures 88 are arranged to provide different substantially stationary radiating patterns in cooking cavity 24, depending upon the phase relationship of the standing wave of the electric field established in the waveguide section. Phase shifting apparatus in accordance with the present invention is illustratively employed to vary the phase relationship of the standing wave in waveguide 50, thereby varying the radiating pattern from waveguide 50 at the cooking plane.

As discussed briefly in the Background, insertion of a single dielectric slab in the waveguide would change the phase of the standing wave propagating therein. However, once inserted, movement of a slab in the waveguide would not vary the phase of the standing wave in the region of the waveguide relatively remote, i.e., more than about a half guide wavelength from the dielectric slab. However, it has been discovered that by terminating the waveguide with a conductive septum which divides the end portion of the guide into two sub-waveguides, thereby acting essentially as a modal filter to block the primary propagating mode in the waveguide, and by inserting a pair of dielectric plugs in each of the sub-waveguides, a phase shift can be introduced which varies linearly with the forward displacement of the plugs relative to the leading edge of the septum when the plugs are moved in tandem longitudinally in the waveguide, and with a proportionality constant which is significantly less than one.

Such phase shifting apparatus in accordance with the present invention is illustratively embodied in section 52 of waveguide section 50. Section 52 is terminated by a metallic septum or divider wall 90 which extends inwardly from end wall 92 of section 52 generally parallel to the narrow waveguide walls 94 and 96 to divide the end portion of waveguide section 52 into two sub-waveguides 98 and 100. Septum 90 is connected by suitable low resistance contacting means, such as welding, to opposed broad walls 102 and 104, which is a portion of wall 34 and end wall 92 of waveguide section 52 to provide a low resistance electrical connection therebetween. As hereinbefore described, the width of the waveguide sections 46, 48 and 50 are chosen to propagate the basic $TE_{01}$ mode. The widths of sub-waveguides 98 and 100 formed by septum 90 are too narrow to progagate the $TE_{01}$ mode and thus exhibit cut-off characteristics at the 2450 MHz operating frequency.

The low impedance leading edge 106 of septum 90, that is the edge nearest the magnetron 40 in the waveguide path, provides a short circuit termination reference point for waveguide section 50. It has been empirically determined that satisfactory results are achieved with septum length, measured from end wall 92 to leading edge 106, in the range of one-quarter to one-half guide wavelength.

A pair of dielectric plugs or blocks 108 and 110 are movably mounted in sub-waveguides 98 and 100, respectively, for tandem longitudinal movement in wave guide section 52. In the illustrative embodiment, the plugs are formed of tetrafluoroethylene ("Teflon"). Alternatively, other types of conventional non-conductive materials could readily be used, provided they have a dielectric constant of 4.2 or greater. The plugs are configured such that when fully recessed in their respective sub-waveguides, plugs 108 and 110 substantially fill the sub-waveguides with just enough clearance to permit the plugs to slide easily. When so recessed, exposed surfaces 112 and 114 of plugs 108 and 110, respectively, are substantially flush with leading edge 106 of septum 90. In the position of the plugs illustrated in FIG. 5A, referred to hereinafter as the first position, the plugs have essentially no phase shifting effect on the standing wave in waveguide section 50, and the phase of the standing wave in the waveguide is determined by the physical location of the septum leading edge 106.

As mentioned briefly hereinbefore, the phase of the standing wave in the waveguide shifts has been found to vary linearly with the forward displacement of the plugs relative to leading edge 106 with a proportionality constant which is less than one. In the illustrative embodiment, the proportionality constant was found to be on the order of 0.3–0.4. This somewhat surprising result provides significant advantages, particularly in structures where spacing is cramped since the reduction in required displacement allows for the us of shorter strokes when using solenoid actuators or smaller cams when using cam drive arrangements.

As used herein, forward displacement refers to positioning of the plugs such that surfaces 112 and 114 of plugs 108 and 110, respectively, are positioned forward of leading edge 106; i.e., closer to magnetron 40 in the waveguide path than leading edge 106. Thus, the phase relationship of the standing wave in waveguide section 50 in accordance with the present invention can be selectively varied by appropriate forward displacement of the dielectric plugs relative to leading edge 106. In the illustrative embodiment, the waveguide 50 is slotted to support one radiating pattern with zero phase shift and a second pattern when the phase is shifted by one quarter guide wavelength. To provide the desired quarter guide wavelength phase shift, a second predetermined position for plugs 98 and 100 is provided in which the plugs are sufficiently forwardly displaced from leading edge 106 to introduce the quarter guide wavelength phase shift. In the illustrative embodiment, a displacement of 0.6 inches has been determined to be sufficient to provide the desired quarter guide wavelength (1.6 inches) phase shift. This second position for plugs 98 and 100 is illustrated in FIG. 5B.

The means employed in the illustrative embodiment for selectively or periodically moving plugs 108 and 110 to selectively vary the phase of the standing wave in waveguide section 50 will now be described. The prime mover is an electric timer motor 116 which is supported from the outer surface of cavity side wall 34 by motor mounting bracket 118. Mounting bracket 118 is suitably secured to wall 34 such as by welding. Motor 116 is secured to bracket 118 by screws 120. Motor drive shaft 122 is drivingly linked to driveshaft 124 of an eccentric cam 126 by a conventional gear train (not shown) enclosed within gear housing 128. Plug drive rods 130 and 132 are integrally formed with a tie bar 134. Rods 130 and 132 project through apertures 136 and 138, respectively, in end wall 92 and are suitably secured in holes 140 and 142 bored in plugs 108 and 110, respectively, such as by gluing. Tie bar 134 linking plug drive rods 130 and 132 is biased into cam-following engagement with eccentric cam 126 by a pair of compression springs 144, each of which encircles one of plug drive rods 130 and 132, and is sandwiched between end wall 92 of waveguide section 52 and tie bar 134. Cam 126 is contoured to provide the desired pattern of movement for the plugs. The contour illustrated enables the plugs to dwell for relatively long periods in the first and second positions illustrated in FIGS. 5A and 5B, respectively, and to move relatively quickly therebetween when the cam is rotated at a constant rate. Motor 116 may be continuously energized to continuously move plugs 108 and 110 between the first and second positions or intermittently energized to allow a desired amount of dwell time at each extreme position or at positions in between. Predetermined dwell times at various positions can also be provided by use of appropriate dead time gear linkages.

Use of a timer motor allows considerable flexibility to make advantageous use of the linear change of phase with displacement of the plugs. However, many other means for moving the plugs could be used. For example, if only movement between two discrete positions is desired, a solenoid plunger could readily be used for selectively positioning the plugs.

To more fully appreciate the utility of the present invention as illustratively embodied in microwave oven 10, the radiating aperture arrangement of waveguide section 50 will now be described in greater detail. It will be recalled that an electric field is supported in waveguide 50 between the top and bottom walls of guide section 50, which field is characterized as a standing wave. This standing wave has a certain phase relationship in the guide which can be defined in terms of either the location of the nodes of the standing wave or the maximum field points, relative to a reference point in the waveguide. In the illustrative embodiment, this reference point is the short circuit reference point provided by leading edge 106 of septum 90. One effect of the short circuit termination for the bottom feed wave guide section 50 provided by leading edge 106 is to establish a standing wave node or minimum field point at leading edge 106. This defines a first phase relationship for the standing wave in guide 50. When this relationship exists in the waveguide, a particular combination of slots in guide 50 is excited to radiate a first radiating pattern in cooking cavity 24. Shifting of the phase of the standing wave changes the phase relationship. Shifting the phase by a quarter guide wavelength establishes a second phase relationship in the waveguide. When this second phase relationship exists in the guide section 50 a different combination of slots is excited to radiate the second radiating pattern in cooking cavity 24.

Referring again to FIG. 3, the arrangements for the radiating apertures 90 to provide the two different radiation patterns will now be described. Each of apertures 88 in the illustrated embodiment is constructed as a series slot; that is, the longitudinal axis of the slot is oriented transverse to the direction of wave propagation in guide section 50. The dimensions of the slots are chosen with a view to evenly distributing the energy along the radiating chamber and to provide the desired impedance matching. Specifically, slot lengths were chosen at substantially less than one-half a waveguide wavelength so as to provide non-resonant slots. This assures that energy is relatively evenly distributed along the length of guide section 50 rather than radiating primarily from those slots nearest the entrance to section 50.

Slots 88 are arranged in two staggered rows, designated generally A and B. Within each row the lateral spacing between the slots is one-quarter guide wavelength. Slot A-1 is located one guide wavelength from leading edge 106. Thus, all the slots of Row A are centered an integral multiple of quarter guide wavelengths from leading edge 106. When guide 50 is terminated by a short circuit at leading edge 106, i.e., plugs 108 and 110 in the first position, slots A-1, A-3, A-5 and A-7 are centered at minimum field or standing wave node points which correspond to maximum power coupling points for series slots, while slots A-2, A-4 and A-6 are at maximum field points corresponding to minimum power coupling points for series slots. When the phase of the standing wave in guide 50 is shifted by a quarter guide wavelength, this situation is reversed with slots A-2, A-4 and A-6 being centered at maximum power coupling points and slots A-1, A-3, A-5 and A-7 being at minimum coupling points.

Slot B-1 is centered seven-eighth guide wavelengths from leading edge 106. Consequently, slots B-1–B-7 are each centered at odd integral multiples of eighth guide wavelengths from end wall 65. Thus, each of slots B-1–B-7 is centered at a half power coupling point, i.e., midway between adjacent maximum and minimum power coupling points when either the first or second phase relationship exists in guide section 50.

Figure 6:
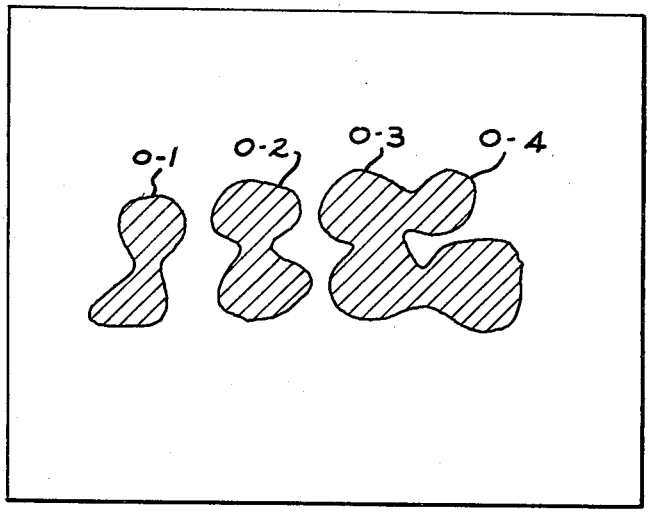
FIG. 6 is a sketch of the radiation pattern at the cooking plane from the bottom waveguide when the phase shifting apparatus is in its first position.
Figure 7:
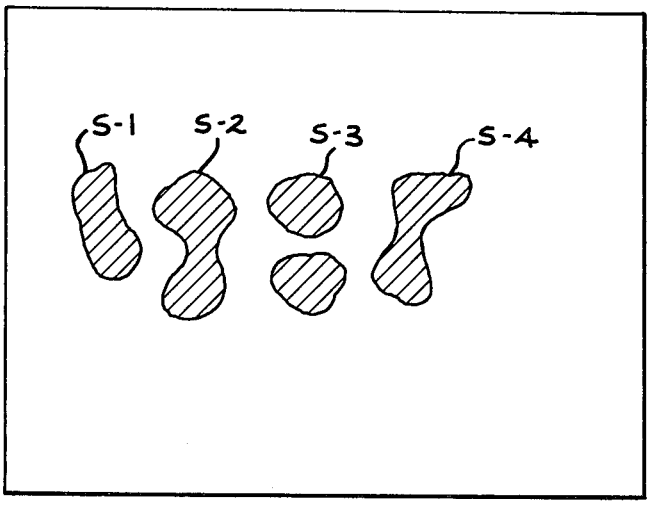
FIG. 7 is a sketch of the radiation pattern at the cooking plane from the bottom waveguide when the phase shifting apparatus is in its second position.
Figure 8:
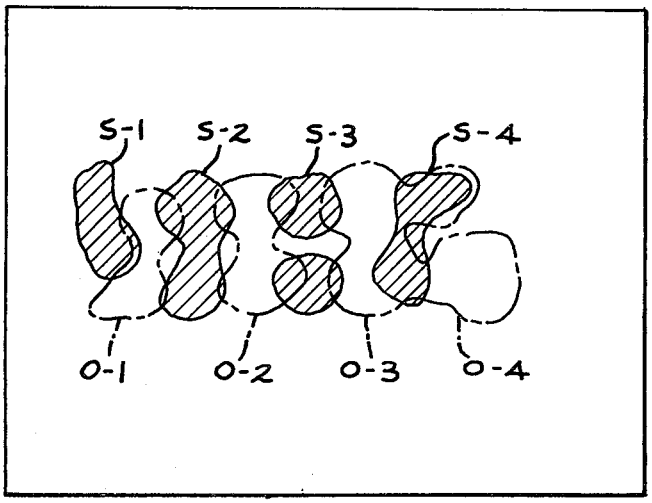
FIG. 8 is a sketch of the radiation pattern of FIG. 7 superimposed over the radiation pattern of FIG. 6 to illustrate the interleaving of the patterns.

FIGS. 6–8 are sketches of representative energy distribution patterns at the cooking plane for the oven of the illustrative embodiment, with FIGS. 6 and 7 representing the energy distribution at the cooking plane from waveguide 50 for the first and second phase relationships, respectively. The cross-hatched regions in each FIGURE represent regions of relatively high energy density. These radiation patterns at the cooking plane are the result of the interference of radiation from the slots of Row B with those slots of Row A centered at the maximum coupling points. More specifically, the radiation from each maximum power point slot in Row A constructively interferes with the radiation from its immediately adjacent half power point slots of Row B to form a region of high energy density at the cooking plane over each three slot clusters.

Figure 5A:
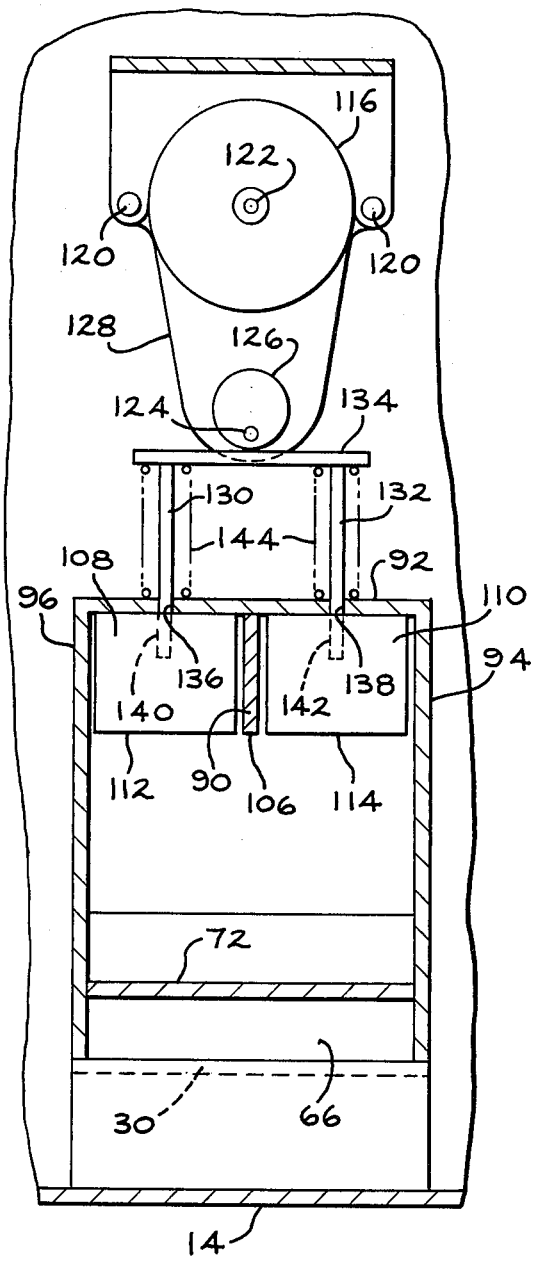
FIGS. 5A and 5B are enlarged schematic views of the mechanism of FIG. 4 with portions broken away for purposes of illustrating the phase shifting apparatus of the microwave oven in its first and second positions, respectively.
Figure 5B:
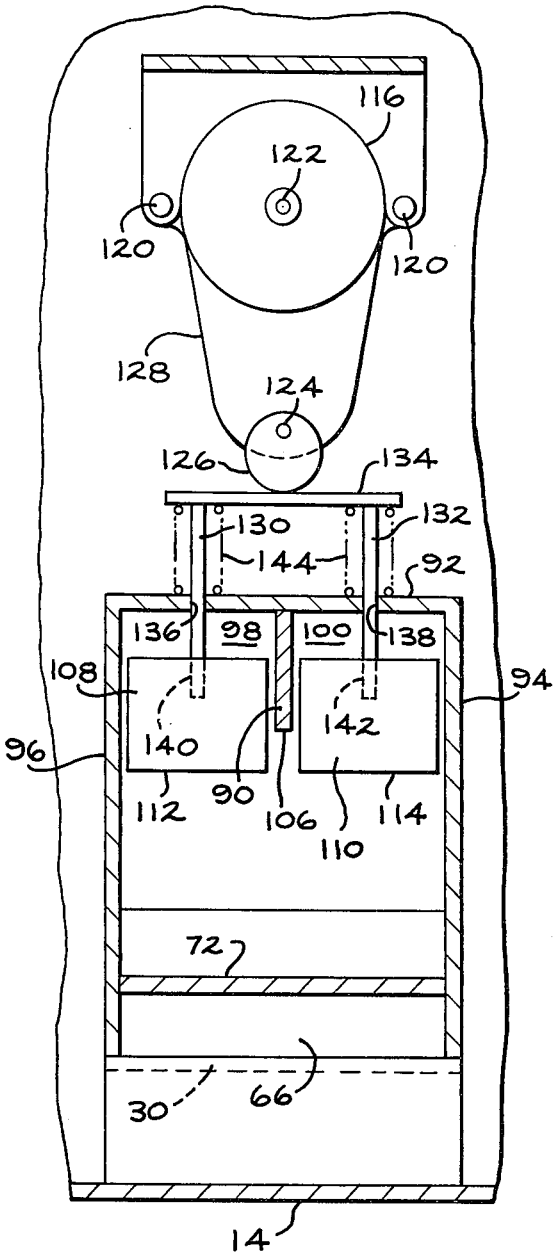

FIG. 6 shows the basic radiation pattern when plugs 108 and 110 are in the first position (FIG. 5A). Region 0-1 is formed by radiation from slot A-1 and B-2; region 0-2 is formed by radiation from slots A-3, B-3 and B-4; region 0-3 is formed by radiation from slots A-5, B-5 and B-6; and region 0-4 is formed by radiation from slots A-7 and B-7. FIG. 7 shows the basic radiation pattern when plugs 108 and 110 are in the second position (FIG. 5B). The phase of the standing wave is shifted by a quarter guide wavelength and, consequently, high intensity region S-1 is formed by radiation from slot B-1; region S-2 is formed by radiation from slots A-2, B-2 and B-3; region S-3 is formed by radiation from slots A-4, B-4 and B-5; and region S-4 is formed by radiation from slots A-6, B-6 and B-7. By periodically moving plugs 98 and 100 between the first and second positions, the radiation pattern at the cooking plane is switched to first and second patterns.

Although in the illustrative example the slot array is arranged primarily to provide two radiating patterns, it should be noted that since the phase shifting device of the present invention provides a linear variation of the phase between the two extreme positions, slots B-1–B-7 would be positioned at maximum power coupling points when the phase is shifted by one-eighth guide wavelength, i.e., when the plugs are at the midpoint between the first and second positions. Thus, the displacement of the plugs could be controlled by appropriate intermittent energization of motor 116 to provide a pause at each of three positions, the first and second positions previously described and a third position midway between these two positions. In this third position, the plugs would establish a third phase relationship in the waveguide during the pause at the third position, resulting in a third radiation pattern with alternate B slots as primary radiators and the adjacent A slots being positioned at the half-power coupling points.

It will be apparent that the capability to control the phase of the standing wave over a continuous range of phase angles as provided by the phase shifting apparatus of the present invention allows much greater flexibility in arranging arrays of slots for selective excitation as a function of the phase of the standing wave in the waveguide, than is possible with conventional mechanical phase shifting devices which typically provide a discrete quarter guide wavelength phase shift by switching between an open circuit and a closed circuit termination.

While the specific embodiment illustrated and described herein incorporates the phase shifting apparatus of the present invention in a microwave cooking oven, it is understood that the apparatus could be readily adapted to other applications requiring means for providing a linear phase shifting capability for a standing wave in a rectangular waveguide. In addition, it is realized that numerous modifications and changes will occur to those skilled in the art. It is therefore to be understood that the appended claims are intended to cover all such modifications and changes as fall within the true spirit and scope of the invention.

What is claimed is:

1. Apparatus for shifting the phase of microwave energy propagating in a hollow waveguide of generally rectangular cross-section comprising a pair of opposed parallel broad walls, joined by a pair of opposed parallel narrow walls, configured to support a predetermined microwave energy propagation mode therein and adapted at one end thereof to receive microwave energy from an external source to establish an electric field in the waveguide characterized by a standing wave field pattern, said apparatus comprising:

a septum formed in the waveguide remote from the one end thereof and extending parallel to the narrow walls and electrically connecting the broad walls, thereby dividing the waveguide into two sub-waveguides, the resultant width of each sub-waveguide being insufficient to support the predetermined propagating mode, said septum having a leading edge disposed toward the one end of the waveguide and defining a short circuit termination for the waveguide;

a pair of dielectric plugs, each mounted in a respective one of said sub-waveguides, for tandem longitudinal movement relative to said leading edge, the phase of the standing wave varying substantially linearly with forward displacement of said plugs toward the one end of the waveguide relative to said leading edge; and means for moving said plugs relative to said leading edge to shift the phase of the standing wave field pattern in the waveguide.

2. The phase shifting apparatus of claim 1 wherein said means for moving said plugs comprises means for periodically moving said plugs in tandem between a first position flush with said leading edge of said septum and a second position forward of said leading edge toward the one end of the waveguide, thereby periodically shifting the phase of the standing wave field pattern in the waveguide.

3. The phase shifting apparatus of claim 1 wherein the ratio of forward displacement of said plug to the shift in phase of the standing wave is less than one.

4. The phase shifting apparatus of claim 2 wherein the displacement between said second position and said first position introduces a quarter guide wavelength phase shift in the waveguide.

5. The phase shifting apparatus of claim 2 wherein said sub-waveguides are of substantially equal width and wherein said plugs in said first position substantially fill said sub-waveguides.

6. Apparatus for shifting the phase of microwave energy propagating in a hollow waveguide of generally rectangular cross-section comprising a pair of opposed parallel broad walls joined by a pair of opposed parallel narrow walls, configured to support a predetermined microwave energy propagation mode therein and adapted at one end thereof to receive microwave energy from an external source to establish an electric field in the waveguide characterized by a standing wave field pattern, said apparatus comprising:

a septum formed in the waveguide, remote from the one end thereof and extending parallel to the narrow walls and electrically connecting the broad walls, thereby dividing the waveguide into two sub-waveguides, each of said sub-waveguides exhibiting a cut-off characteristic at the operating frequency, said septum providing a short circuit termination for the waveguide at its leading edge;

a pair of dielectric plugs each received in a respective one of said sub-waveguides for selective movement in tandem from said sub-waveguides into the waveguide, the phase of the standing wave in the waveguide varying as a function of the displacement of said plugs relative to said leading edge; and means for selectively moving said plugs in tandem from their respective sub-waveguides into the waveguide.

7. The apparatus of claim 6 wherein the phase of the standing wave in the waveguide varies substantially linearly with the displacement of said plugs as said plugs move from said sub-waveguide into said waveguide with a ratio of displacement to phase shift which is less than one.

8. The apparatus of claim 6 wherein the length of extension of said septum into the waveguide is in the range of one-quarter to one-half guide wavelength.

9. The apparatus of claim 7 wherein said means for selectively moving said plugs moves said plugs between a first position in which said plugs are substantially contained within said sub-waveguides, and a second position in which said plugs extend from said sub-waveguides a predetermined distance into the waveguide.

10. The apparatus of claim 9 wherein movement from said first position to said second position shifts the phase of the standing wave by one quarter guide wavelength.

11. In a microwave cooking cavity excitation system of the type comprising a hollow rectangular feed waveguide extending along one wall of the cooking cavity, a source of microwave energy coupled to one end of the waveguide to establish an electric field between opposing walls of the waveguide, which field is characterized by a predetermined standing wave field pattern, the waveguide being configured to support a predetermined propagating mode therein, and an array of spaced apart apertures formed along the length of the waveguide to support a radiating pattern in the cavity which changes as a function of changes in the phase of the standing wave in the waveguide and means for selectively shifting the phase of the standing wave to selectively radiate different radiating patterns, the improvement wherein the means for selectively shifting the phase of the standing wave comprises:

a septum formed in the waveguide remote from the one end thereof, extending parallel to the narrow walls of the rectangular waveguide and electrically connecting the broad walls thereof, thereby dividing the waveguide into two sub-waveguides, the resultant width of each of said sub-waveguide being insufficient to support the predetermined propagating mode, said septum having a leading edge pointing toward the one end of the waveguide, said edge defining a short circuit termination point for the waveguide;

a pair of dielectric plugs each mounted in a respective one of said sub-waveguides for tandem longitudinal movement relative to said leading edge, the phase of the standing wave varying as a function of said movement;

means for selectively moving said dielectric plugs relative to said leading edge, thereby shifting the phase of the standing wave in the waveguide.

12. The improvement of claim 11 wherein the phase of the standing wave varies linearly with the forward displacement of said plugs toward the source of microwave energy relative to said leading edge with a ratio of forward displacement to phase shift which is less than one.

13. The improvement of claim 11 wherein said plugs are movable between a first position in which that one surface of each of said plugs facing the interior of the waveguide is substantially flush with said leading edge; and a second position wherein said one surface is sufficiently forwardly displaced relative to said leading edge to introduce a quarter guide wavelength phase shift in the waveguide.

14. In a microwave cooking cavity excitation system of the type comprising a hollow rectangular feed waveguide extending along one wall of the cooking cavity, a source of microwave energy coupled to one end of the the waveguide to establish an electric field between opposing walls thereof, characterized by a predetermined standing wave field pattern, the waveguide being configured to support a predetermined propagating mode therein, and including an array of spaced apart apertures formed along the length of the waveguide to support a first radiating pattern in the cavity when a first phase relationship exists in the waveguide and to support a second radiating pattern in the cavity when a second phase relationship exists in the waveguide and means for periodically shifting the phase of the standing wave between the first and second phase relationship, the improvement wherein the means for periodically shifting the phase of the standing wave comprises:

a septum formed in the waveguide remote from the one end thereof, extending into the waveguide parallel to the narrow walls of the rectangular waveguide and electrically connecting the broad walls thereof, thereby dividing the waveguide into two sub-waveguides the resultant width of each of said sub-waveguides being insufficient to support the predetermined propagating mode, said septum having a leading edge pointing toward the one end of the waveguide, said edge defining a short circuit termination point for the waveguide;

a pair of dielectric plugs each mounted in a respective one of said sub-waveguides for tandem longitudinal movement between a first position and a second position forward of said first position in the direction of the source of microwave energy, said first position providing a termination point which enables the first phase relationship for the standing wave in the waveguide and said second position providing a termination position which enables the second phase relationship; and reciprocating means for periodically moving said dielectric plugs between said first position and said second position thereby periodically shifting the phase relationship of the standing wave propagating in the waveguide between the first phase relationship and the second phase relationship.

15. The improvement of claim 14 wherein the length of extension of said septum into the waveguide is in the range of one-quarter to one-half guide wavelength.

16. The improvement of claim 14 wherein the displacement between said first position and said second position introduces a one quarter guide wavelength phase shift in the waveguide.

17. The improvement of claim 14 wherein the phase of the standing wave varies linearly with the displacement of said plugs as said plugs move between said first and second positions.

18. The improvement of claim 17 wherein said plugs each have one surface facing the interior of said waveguide in said first position, said plugs in said first position substantially filling said respective sub-waveguides with said one surface flush with said leading edge.

* * * * *